US009455131B2

(12) United States Patent
Thomson

(10) Patent No.: US 9,455,131 B2
(45) Date of Patent: Sep. 27, 2016

(54) GAS DIFFUSER ION INLET

(71) Applicant: DH Technologies Development Pte. Ltd., Singapore (SG)

(72) Inventor: Bruce Thomson, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/369,271

(22) PCT Filed: Nov. 28, 2012

(86) PCT No.: PCT/IB2012/002538
§ 371 (c)(1),
(2) Date: Jun. 27, 2014

(87) PCT Pub. No.: WO2013/098606
PCT Pub. Date: Jul. 4, 2013

(65) Prior Publication Data

US 2014/0353496 A1 Dec. 4, 2014

Related U.S. Application Data

(60) Provisional application No. 61/580,682, filed on Dec. 28, 2011.

(51) Int. Cl.

| | |
|---|---|
| ***H01J 49/00*** | (2006.01) |
| ***H01J 49/04*** | (2006.01) |
| ***B05B 1/00*** | (2006.01) |
| ***H01J 49/24*** | (2006.01) |
| ***H01J 49/26*** | (2006.01) |

(52) U.S. Cl.
CPC ..... *H01J 49/0422* (2013.01); *B05B 1/005* (2013.01); *H01J 49/0404* (2013.01); *H01J 49/24* (2013.01); *H01J 49/26* (2013.01)

(58) Field of Classification Search
USPC ..... 250/289
See application file for complete search history.

(56) References Cited

U.S. PATENT DOCUMENTS

| | | | | |
|---|---|---|---|---|
| 2006/0192107 | A1 | 8/2006 | Devoe et al. | |
| 2009/0072133 | A1 | 3/2009 | Schultz et al. | |
| 2009/0140140 | A1 | 6/2009 | Raznikov et al. | |
| 2009/0294650 | A1 | 12/2009 | Schneider et al. | |
| 2011/0068263 | A1* | 3/2011 | Wouters et al. | 250/282 |

FOREIGN PATENT DOCUMENTS

| | | |
|---|---|---|
| JP | 2008-041648 | 2/2008 |

OTHER PUBLICATIONS

International Search Report from International Patent Application No. PCT/IB2012/002538, dated Apr. 22, 2013.

* cited by examiner

*Primary Examiner* — Phillip A Johnston

(57) ABSTRACT

In some embodiments, a gas diffuser for use in a mass spectrometer is disclosed that can provide a controlled expansion of an ion-containing gas so as to reduce gas velocity for entry into subsequent stages of the mass spectrometer, e.g., a mass analyzer. In some embodiments, the controlled expansion of the gas is provided by flowing the gas through a channel whose cross-sectional area change, e.g. progressively increases, in the direction of the gas flow so as to provide controlled expansion of the gas.

7 Claims, 7 Drawing Sheets

GAS DIFFUSER ION INLET

RELATED APPLICATION

This application claims priority to U.S. provisional application No. 61/580,682 filed Dec. 28, 2011, which is incorporated herein by reference in its entirety.

FIELD

The invention relates generally to a gas diffuser inlet for use in analytical instruments including mass spectrometers.

INTRODUCTION

Mass Spectrometry (MS) is an analytical technique that measures the mass-to-charge ratio of charged particles. It is used for determining masses of particles, for determining the elemental composition of a sample or molecule, and for elucidating the chemical structures of molecules, such as peptides and other chemical compounds. Mass spectrometry comprises ionizing chemical compounds to generate charged molecules or molecule fragments and measuring their mass-to-charge ratios.

In a typical MS procedure, a sample is loaded onto the MS instrument, and undergoes vaporization. The components of the sample are then ionized by one of a variety of methods (e.g., by impacting them with an electron beam), which results in the formation of charged particles (ions). The ions are then separated according to their mass-to-charge ratio in an analyzer by electromagnetic fields. The ions are detected, usually by a quantitative method. Finally, the ion signal is processed into mass spectra.

A typical Mass Spectrometer instrument comprises three modules: (a) an ion source, which can convert gas phase sample molecules into ions (or, in the case of electrospray ionization, move ions that exist in solution into the gas phase); (b) a mass analyzer, which sorts the ions by their masses by applying electromagnetic fields; and (c) a detector, which measures the value of an indicator quantity and thus provides data for calculating the abundances of each ion present.

The mass analyzer is typically housed in a high vacuum chamber (P=about $10^{-5}$ Torr). In some cases, ions are introduced from a high pressure ion source, e. g., an ion source that operates at a pressure of up to atmospheric pressure, and ions are transferred through a small aperture or channel into the mass analyzer. One or more intermediate vacuum chambers or vacuum stages can be used between the ion source and the mass analyzer vacuum chamber to reduce the pressure in stages, a technique known in the art as differential pumping. Each vacuum chamber or stage typically contains ion focusing elements to focus the ions through the chamber while allowing some of the gas to be pumped away. Typically it is an object of a differential pumping system to maintain high efficiency in focusing the ions while the gas is pumped away. The technique has both qualitative and quantitative uses. These include identifying unknown compounds, determining the isotopic composition of elements in a molecule, and determining the structure of a compound by observing its fragmentation. Other uses include quantifying the amount of a compound in a sample or studying the fundamentals of gas phase ion chemistry (the chemistry of ions and neutrals in a vacuum). MS is now in very common use in analytical laboratories that study physical, chemical, or biological properties of a great variety of compounds.

When ions are introduced into the first stage vacuum chamber of a mass spectrometer from an ion source that operates at atmospheric pressure, such as an electrospray ion source, both gas and ions enter the vacuum chamber. The gas stream can form a supersonic free jet expansion that can form a directed gas jet downstream of the free jet. This directed gas jet carries the ions at high velocity along the axis of the gas stream.

In order to properly focus ions through the first stage vacuum chamber of the mass spectrometer, the ions and the gas need to be appropriately slowed. If for example, a gas jet propels the ions to be analyzed all the way to the end of the first vacuum chamber then it is difficult to efficiently focus the ions, and the sensitivity of the analyzer is compromised. Additionally, if the gas jet reaches the end of the first vacuum chamber, it can result in a higher gas flow through the next aperture into the second vacuum stage, requiring the use of larger pumps in the second vacuum stage to handle the higher gas flow. This effect of the gas jet against the wall or exit aperture is known generally as an impact pressure. Smaller orifices at the entrance of the vacuum chamber have been used in the past to reduce the volume of gas flow and the velocity of the gas jet as a remedy for this problem, allowing ions to be more efficiently focused. However, such smaller orifices can result in fewer ions entering the first stage, and therefore can result in reduced sensitivity. Accordingly, improved methods and systems for introducing ions into a mass spectrometer are desired.

SUMMARY

The present disclosure is generally directed to a gas diffuser for use in a mass spectrometer, comprising an input aperture for receiving a flow of a gas; and a gas flow conduit that extends from said input aperture to an exit aperture and is configured to provide a controlled expansion of the gas from the input aperture to the exit aperture. For example, in some embodiments, the passage of the gas through the conduit can reduce the gas velocity by a factor in a range of about 10% to about 50% as the gas moves from the input aperture to the exit aperture. In some embodiments, the conduit can comprise a first gas flow region or channel that extends to the second gas flow region or channel, where at least one of the gas flow regions or channels, and in some embodiments both, can exhibit an increasing cross-sectional area in a direction of the exit aperture.

In some embodiments, the first gas flow region can comprise a substantially annular channel that extends from the input aperture to an inflection section beyond which the second gas region extends to the exit aperture.

In some embodiments, both of the first and second gas flow regions can exhibit an increasing cross-sectional area in the direction of the exit aperture to provide controlled expansion of the gas. In some such embodiments, the first and second gas flow regions are configured such that the rate of gas expansion in the second flow region is greater than that in the first gas flow region.

In some embodiments, the input aperture of the gas diffuser can be annular.

In further aspects, the gas flow channel or conduit can comprise a curved outer wall and a curved inner wall. The gas flow channel can be formed in a number of manners, including but not limited to, by a solid core positioned in a cavity provided by said outer wall, wherein the outer surface of the solid core forms the curved inner wall of the channel. In some embodiments of the gas diffuser comprising a channel with a curved inner and outer wall, each of said curved inner and outer walls diverges away from a longitudinal axis of the gas diffuser as each of the walls extends from said input aperture to a respective inflection section. Optionally, in some embodiments where the curved walls of the diffuser diverge away from the longitudinal axis of the gas diffuser, said inner and outer walls then may converge toward the longitudinal axis of the gas diffuser as each of the walls extends from a respective inflection section to the exit aperture.

In further aspects, the gas diffuser may comprise a channel or conduit for gas flow with a porous membrane at the exit aperture. In some embodiments, the channel can be cylindrical.

In further aspects, the gas diffuser is configured to provide a controlled expansion of the gas introduced into the gas diffuser, wherein said controlled expansion can cause a reduction by a factor in a range of about 20% to about 50% in the velocity of the gas as it flows from the input aperture to the exit aperture of the gas diffuser.

In further aspects, the gas diffuser can comprise an array or plurality of input apertures for transferring a flow of gas and ions from a high pressure ion source region into a lower pressure first vacuum stage of a mass spectrometer. The array of apertures can provide a distributed array of small supersonic free jets and gas jets that can provide a lower net gas velocity into and through the first vacuum stage.

In some embodiments, a mass spectrometer system is disclosed, which comprises a vacuum chamber and a gas diffuser that is coupled to the chamber for introducing gas for a source, which can be located external to the chamber, into the chamber. The gas diffuser is configured to reduce the velocity of gas introduced into the chamber relative to a gas velocity that would be obtained if the gas were to be introduced into the chamber via a supersonic free jet expansion. In some cases, the mass spectrometer system can further comprise a second chamber that is coupled to the first chamber via an orifice, and the gas diffuser is configured to reduce the gas flow into the second chamber by reducing impact pressure at that orifice.

These and other features of the applicant's teachings are set forth herein.

DRAWINGS

The skilled person in the art will understand that the drawings, described below, are for illustration purposes only. The drawings are not intended to limit the scope of applicants' teachings in any way.

DESCRIPTION OF VARIOUS EMBODIMENTS

Aspects of the applicants' teachings may be further understood in light of the following description, which should not be construed as limiting the scope of applicants' teachings in any way.

This disclosure is generally directed to a gas diffuser or velocity reducer to slow the speed of a gas jet entering a vacuum chamber of a mass analyzer so that the ions carried by the gas can be more effectively focused.

In a vacuum expansion of a gas carrying ions, there is typically a need to slow the expansion speed of the gas without limiting the ion flux and without causing ion losses to walls. The latter can reduce both the sensitivity of the instrument and the precision and accuracy of the measurement.

Figure 1:
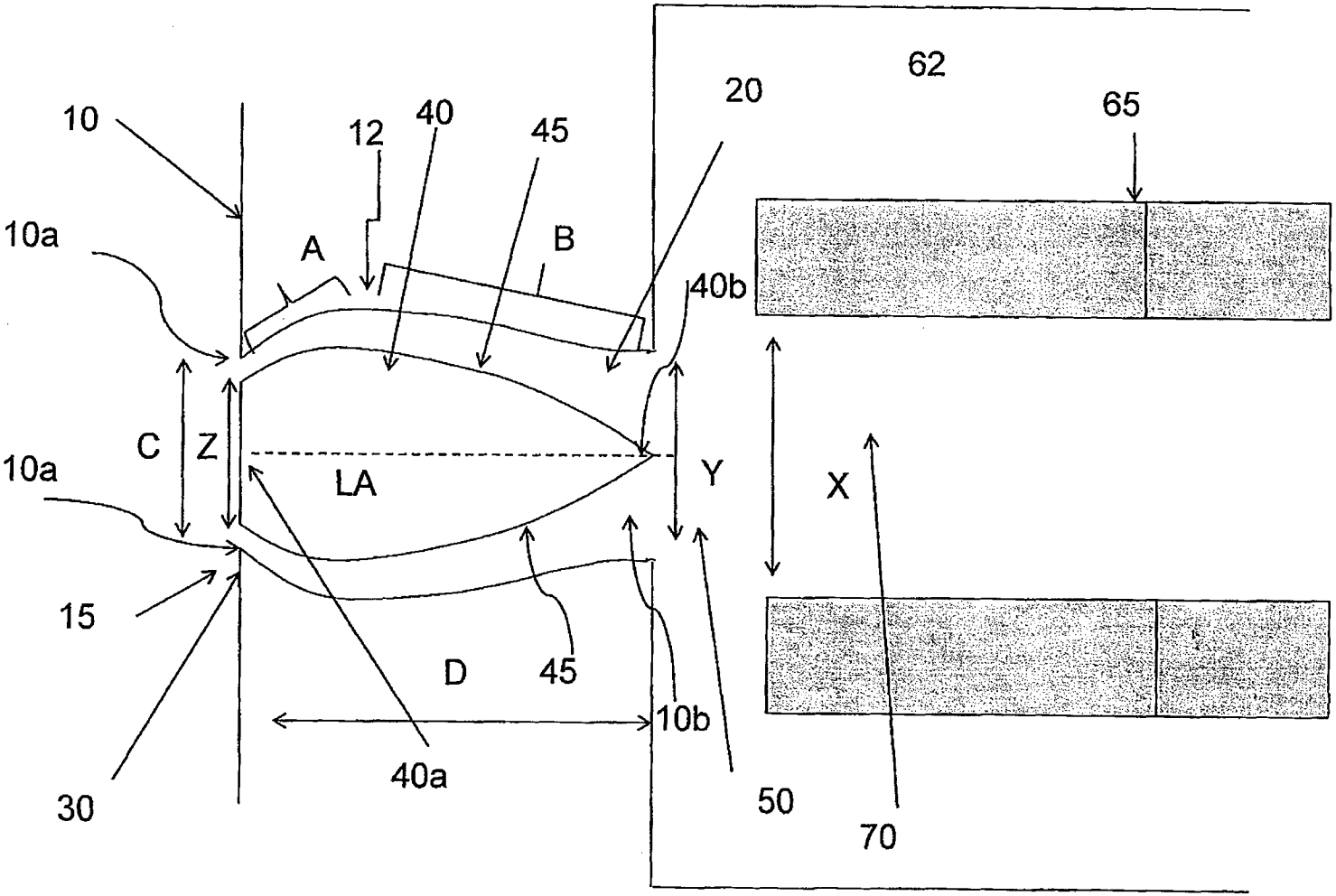
FIG. 1 is a cross sectional view of an embodiment of a gas diffuser according to the applicants' teachings.

In some embodiments, as shown in FIG. 1, a gas diffuser 10 can comprise an annular input aperture 10*a* that allows entry of an ion containing gas into a channel or conduit 15 that is formed between an outer curved wall 30 and a solid core 40, which provides an inner curved wall 45 of the conduit. In this illustrative embodiment, the solid core 40 extends from a proximal surface 40*a* to a distal tip 40*b*. As discussed below, the conduit 15 allows for controlled expansion of the gas as it flows from the input aperture 10*a* to an exit aperture 10*b*, thereby providing controlled reduction of the gas velocity.

In the instant embodiment, the channel 15 comprises a first gas flow region A that extends from the input aperture 10*a* to an inflection section 12. In this illustrative embodiment, in the first gas flow region A, the outer wall 30 and the inner wall 45 of the channel 15 diverge away from a longitudinal axis (LA) of the gas diffuser along a direction away from the input aperture. The channel 15 further comprises a second region B that extends from the inflection section 12 to the output aperture 10*b*. In this illustrative embodiment, in the second gas flow region, the outer wall 30 and the inner wall 45 converge toward the longitudinal axis (LA) along a direction toward the output aperture, though at different rates. In this illustrative embodiment, in both regions, the cross-sectional area of the channel progressively increases in a direction from the input aperture to the output aperture with a greater rate of increase in the second region B.

In some embodiments, the first gas flow region can be a substantially annular channel. In some such embodiments, the first gas flow region can comprise a channel having a substantially uniform cross-sectional area over its length.

The gas introduced into the gas diffuser via the input aperture 10*a* first expands within the first gas flow region and then further expands in the second gas flow region of the conduit 15, where the expansion in the second region is more rapid than that in the first region. The combined expansion of the gas in the first and second channel regions results in a controlled reduction of the gas velocity. As the gas flows through the channel, it can maintain contact with the inner and outer walls 30 and 45 (e.g., due to Coanda effect (attraction of a moving fluid toward a solid wall or surface))—that is, the boundary layers of the gas flow remain in contact with the walls. The ion-containing gas exiting the gas diffuser through the output aperture 10*b* enters a first vacuum chamber 62 of a mass analyzer that is disposed downstream from the gas diffuser. In this illustrative embodiment, the vacuum chamber contains an RF (radio frequency) ion guide 65 to capture and focus the ions into a second vacuum chamber. The RF ion guide can be an RF multipole or an RF ring guide or an RF or DC ion funnel.

Although typical sizes and distances can vary, the cross section of the inner solid core at the portion of the gas diffuser where the gas enters the diffuser (Z) is typically in a range of about 1.8 mm to about 8 mm, e.g., about 4.6 mm. The annular ring typically has a diameter (C) of between about 2 and about 10 mm and is often about 5 mm. The output aperture 10*b* where the gas jet exits the diffuser has generally a circular shape with a diameter (Y) in a range of about 2 to about 10 mm, and in various embodiments, a diameter greater than the diameter of the annular ring. In some embodiments, the diameter of output aperture 10*b* where the gas jet exits is about 8 mm. The gas diffuser can have a variety of thicknesses commensurate with the other dimensions. In one example the diffuser has a thickness (D) (a size along the longitudinal axis (LA)) that ranges between about 2 and about 10 mm and in some embodiments is about 10 mm.

Figure 2:
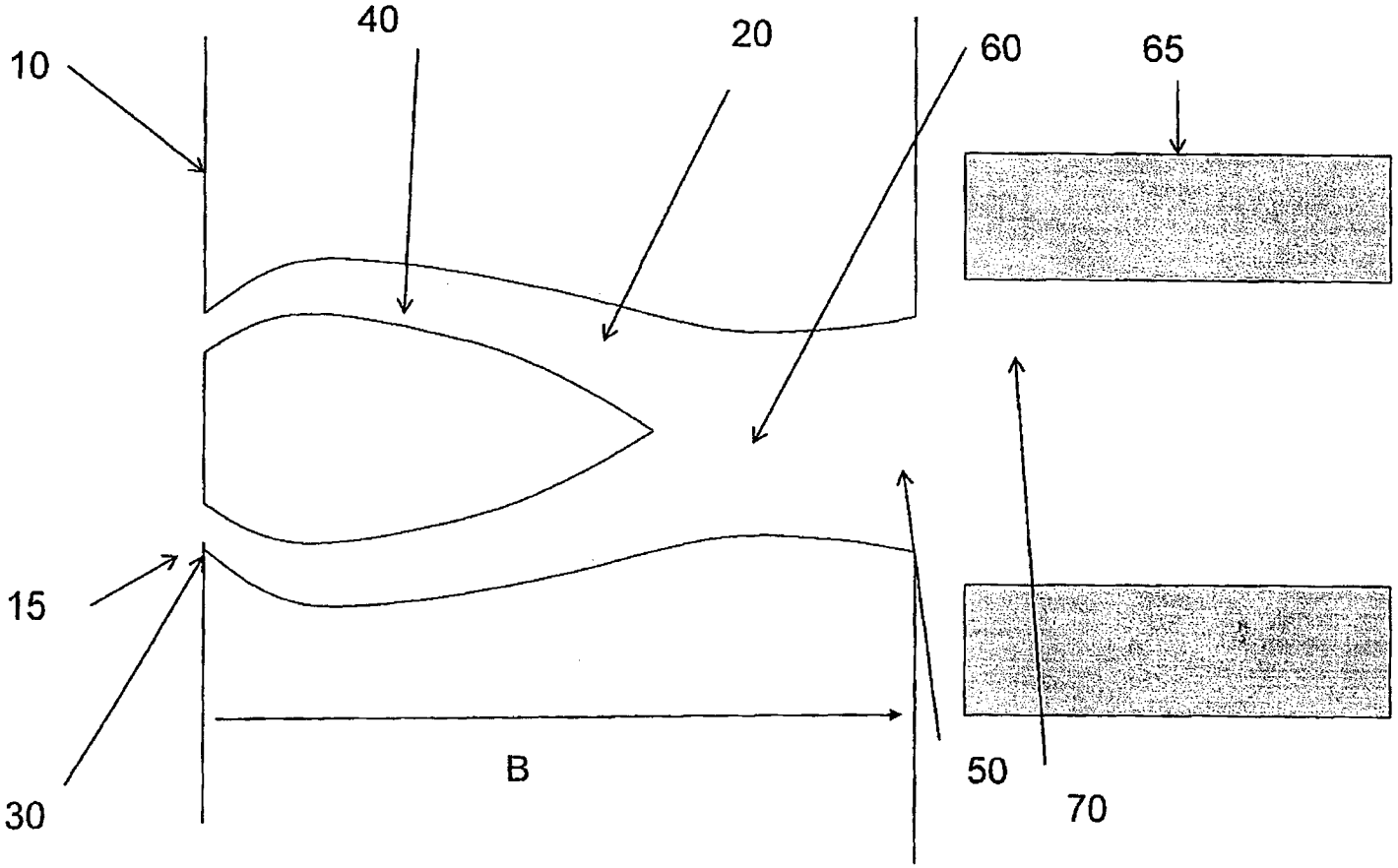
FIG. 2 is a cross sectional view of another embodiment of a gas diffuser according to the applicants' teachings.

In some cases the outer wall 30 can extend beyond distal end of the solid core to avoid a sudden re-expansion of the gas into a subsequent vacuum chamber. For example, as shown in FIG. 2, the extension of the outer wall of the channel beyond the distal end of the solid core can result in a long channel 60 proceeding towards the exit aperture 50. Again dimensions may vary, but in some embodiments, the thickness of the diffuser (B) can range from about 5 to about 20 mm. It should be noted that the continuation of the outer walls past the solid inner core will also vary in distance but in some embodiments that comprise such an extension of the channel, the length of the channel between the distal end of the sold inner core and the output aperture 10*b* can be typically about 30-100% of the thickness of the solid inner core.

The gas diffuser can be used as the first aperture into an ion guide 65 located in vacuum chamber 62 of a mass spectrometer analyzer. The dimensions of the ion guide can be selected to match the diameter of the gas and ion beam exiting from the diffuser. In this illustrative embodiment, the ion guide can have a substantially circular input aperture with a diameter (X) of between about 4 and about 20 mm. In some embodiments, the diameter (X) can be about 15 mm. Typically the ratio of the diameter (X) of the ion guide 65 relative to the diameter (Y) of the output aperture of the gas diffuser can be between about 1 to about 1.5 and in some embodiments in a range about 1 to 2.

Generally, the pressure in the vacuum chamber 62 can be between about 1 Torr and about 30 Torr (wherein approximately 760 Torr is atmospheric pressure). In some embodiments, the vacuum chamber 62 can comprise an ion focusing device 65, such as an RF ion guide, e.g., an RF multipole (e.g., RF quadrupole, hexapole or octapole) or an RF ring guide or ion tunnel or ion funnel. Other RF containment or focusing devices can also be used.

Figure 3:
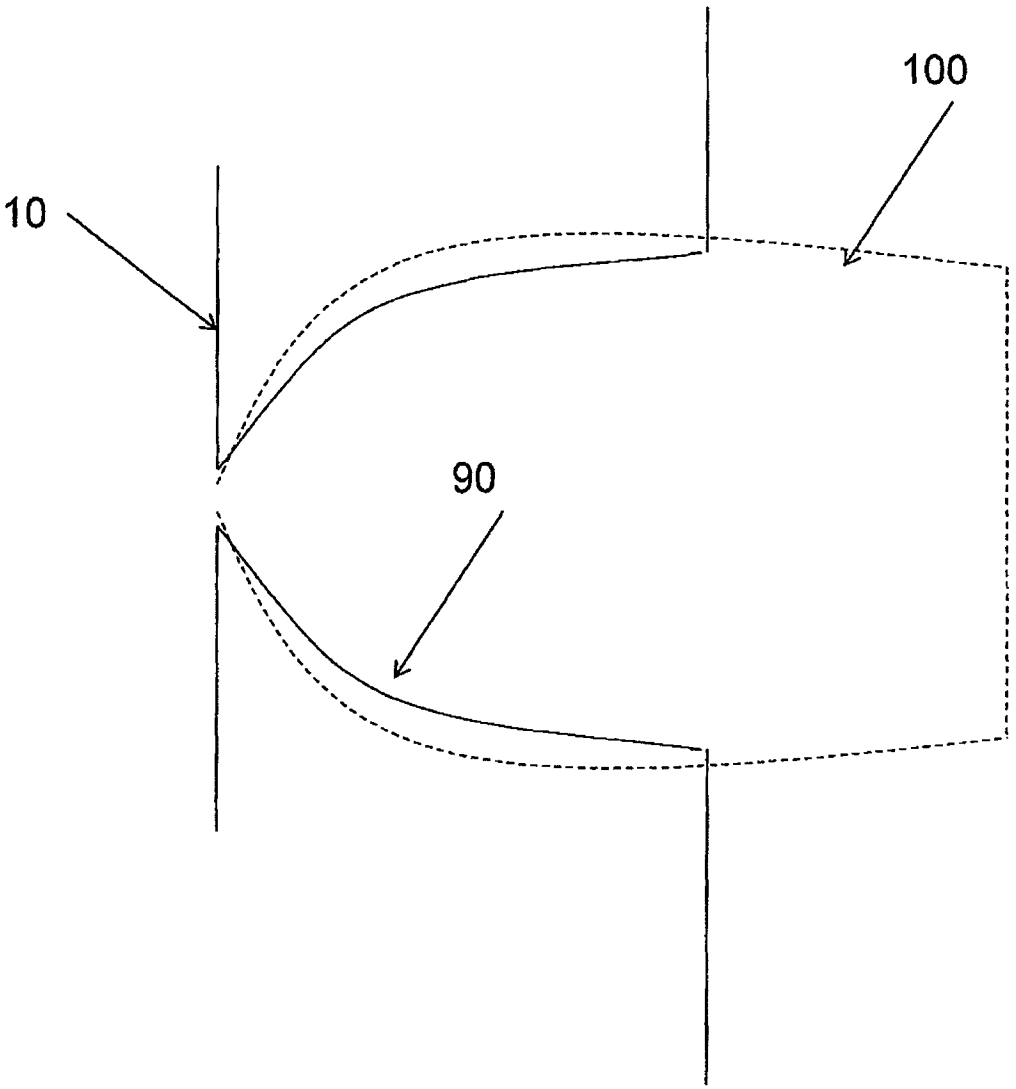
FIG. 3 is a cross sectional view of another embodiment of a gas diffuser according to the applicants' teachings.

In some embodiments, the gas diffuser 10 can be formed without the solid inner element. For example, in some such embodiments, the gas expansion and velocity can be controlled by the surface shape of the outer wall 90, e.g., as shown in FIG. 3. In this illustrative embodiment, the wall 90 is curved and flares out from an input aperture 10*a* to an output aperture 10*b*, thereby providing an inner volume with a progressively increasing cross-section from the input aperture to the output aperture for facilitating controlled expansion of the gas. In this illustrative embodiment, the wall 90 is positioned within an outer boundary that would be formed by a free jet expansion 100 (the shape and size of which is well known, according to the orifice diameter and the pressure in the chamber) through the input aperture (i.e., a gas expansion through the input aperture in absence of the wall 90).

Figure 4A:
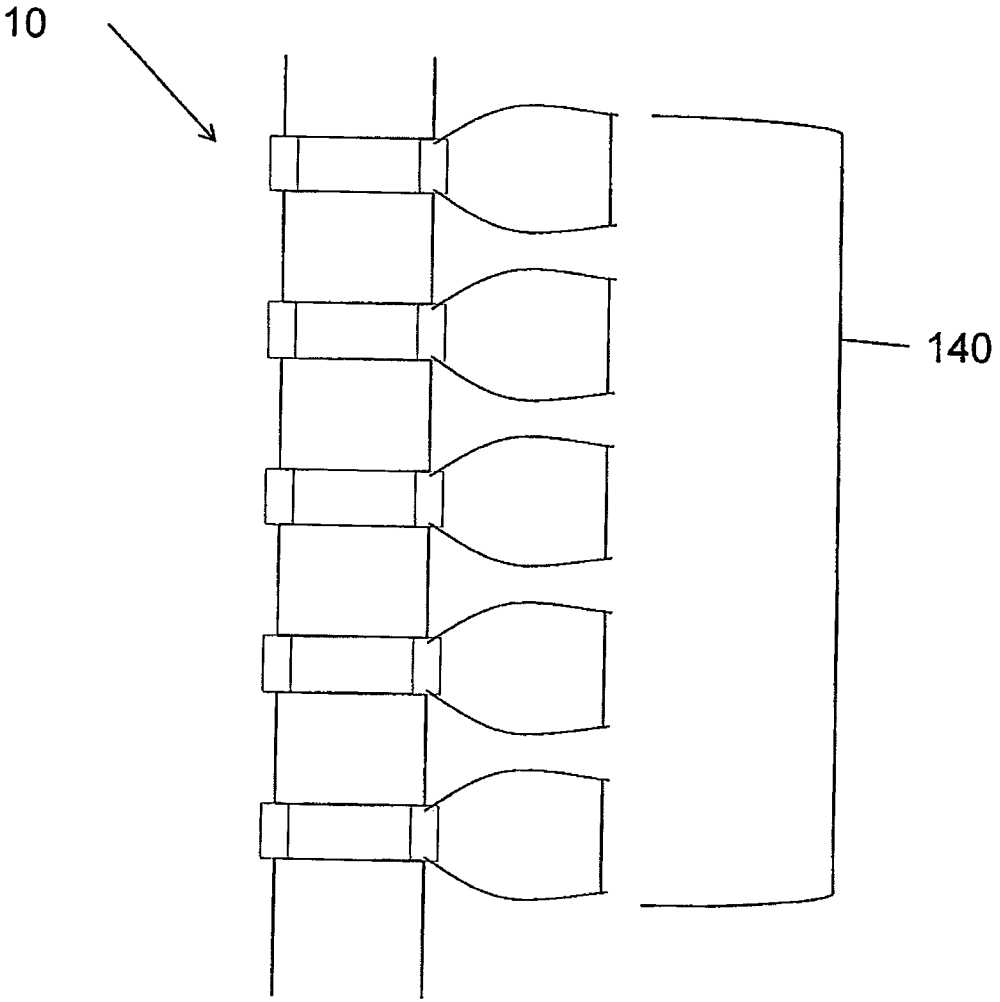
FIGS. 4A and 4B are cross sectional views of another embodiment of a gas diffuser according to the applicants' teachings.
Figure 4B:
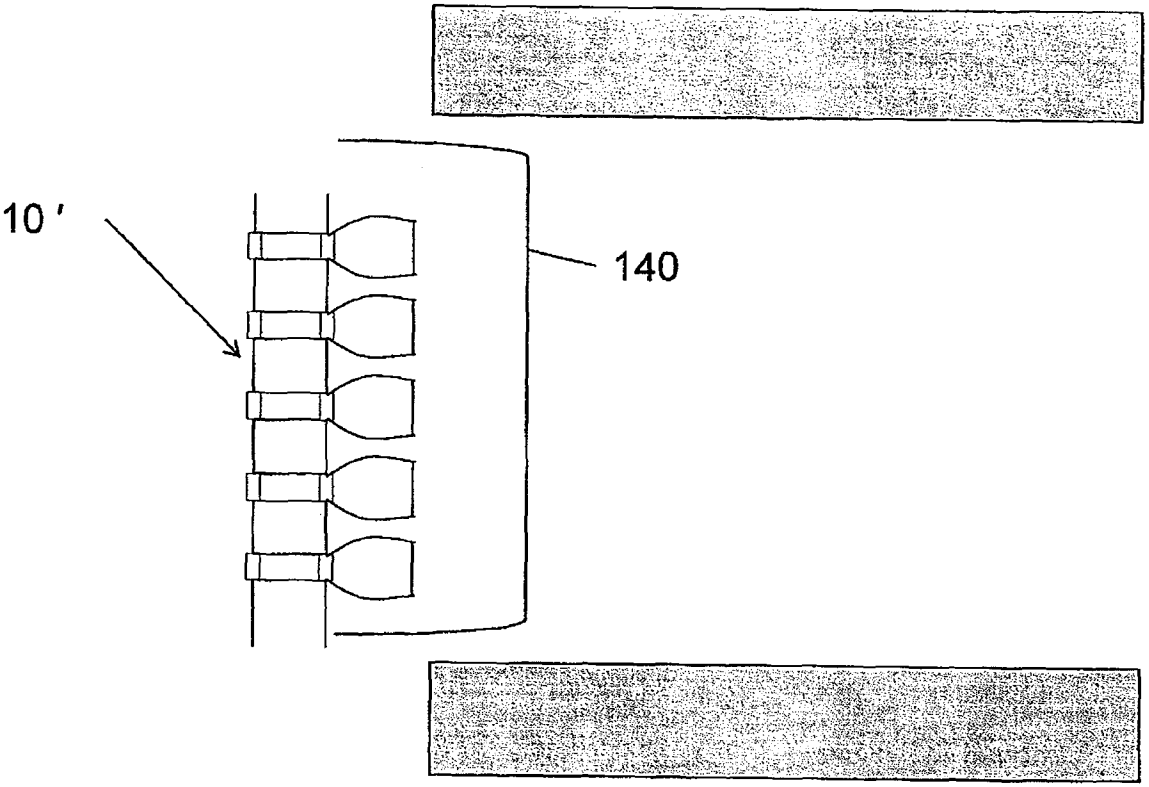

In some embodiments, a gas diffuser 10' can comprise multiple gas diffusing elements 140 that can be used to form small localized jets, each jet having a small diameter relative to the area defined by the distribution of the jets on the diffuser as shown in FIGS. 4A and 4B. The gas diffusing elements can be implemented in a variety of ways. In some embodiments, the gas diffusing elements can be in the form of an array of apertures (holes) that can have a net effect of reducing the gas velocity. In some embodiments, the gas diffusing elements can be implemented as those discussed above in the preceding embodiments and shown in FIGS. 1-3. In some embodiments, the use of multiple small gas jets can prevent the formation of a large axial gas flow rate along the axis while still allowing a large number of ions to enter a downstream vacuum chamber. If the gas diffusing elements are spaced apart sufficiently then the barrel shock wave formed by the gas flow as the gas exits the exit aperture of a gas diffusing element does not interact with a respective shock wave associated with an adjacent aperture. In this manner, the gas expansion through each of the apertures can be independent from that through the other apertures, resulting in a momentum from each gas jet through each aperture that is relatively small. In some embodiments, each aperture or channel can be formed like the gas diffuser depicted in FIG. 3 with suitable dimension. For example, each of at least ten apertures can have a diameter of about 0.25 mm and each barrel shock may be no more than 3 mm in diameter at a given pressure of the incoming gas jet. Consequently, in some such embodiments, the apertures would be spaced apart by at least 1.5 mm. The apertures can be arranged so that they are disposed relative to one another in any desired pattern, e.g., any two-dimensional pattern within an area, including a line, a circle or a random pattern. An RF Ion guide that is larger in cross-sectional area than the cross-sectional area of the pattern of apertures or channels can be used to contain and focus the ions exiting the apertures of the multiple gas diffusing elements. By way of non-limiting example, an RF ring guide or an RF multipole having an inner diameter of about 10 mm can be used.

Figure 5:
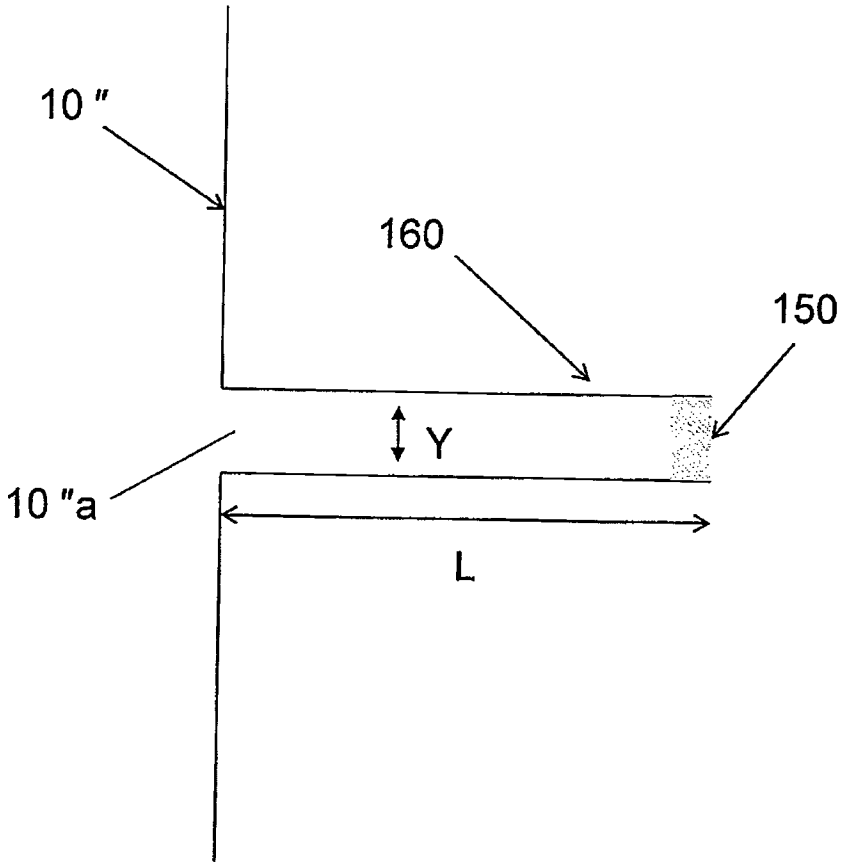
FIG. 5 is a cross sectional view of another embodiment of a gas diffuser according to the applicants' teachings.

In some embodiments, a gas diffuser 10" according to the applicants' teachings can comprise a porous membrane 150 located at the end of a channel 160 as shown in FIG. 5. Ions enter the channel 160 via an input aperture 10"*a* and exit the channel through the porous membrane 150. The porous membrane can comprise a porous glass or a porous metal such as stainless steel frit, or a metal plug containing many small channels. The size, diameters and numbers of holes in the plug can be adjusted to provide the required gas flow into the vacuum system, and can be obtained by routine experimentation. In some embodiments, the porous membrane can be about 5 mm thick, containing channels that are about 0.1 mm in diameter or less. In some embodiments, the channel 160 can be cylindrical, although not necessarily so. The channel 160 can be of varying widths and lengths. In some embodiments, it can have a width (Y) (diameter if cylindrical) of between about 0.5 to about 2 mm, and a length (L) of between about 5 to about 20 mm. This embodiment can improve the contact time between the gas and the channel's wall, thus helping heat transfer between the gas and the wall. In some embodiments the channel and porous membrane can be heated to improve desolvation, and to reduce adsorption of organic contamination materials to the walls. In some embodiments, the porous membrane can inhibit the entry of contaminants, such as particles, in the gas, if any, into subsequent stages which could otherwise contaminate the surfaces and cause ion loss.

Figure 6:
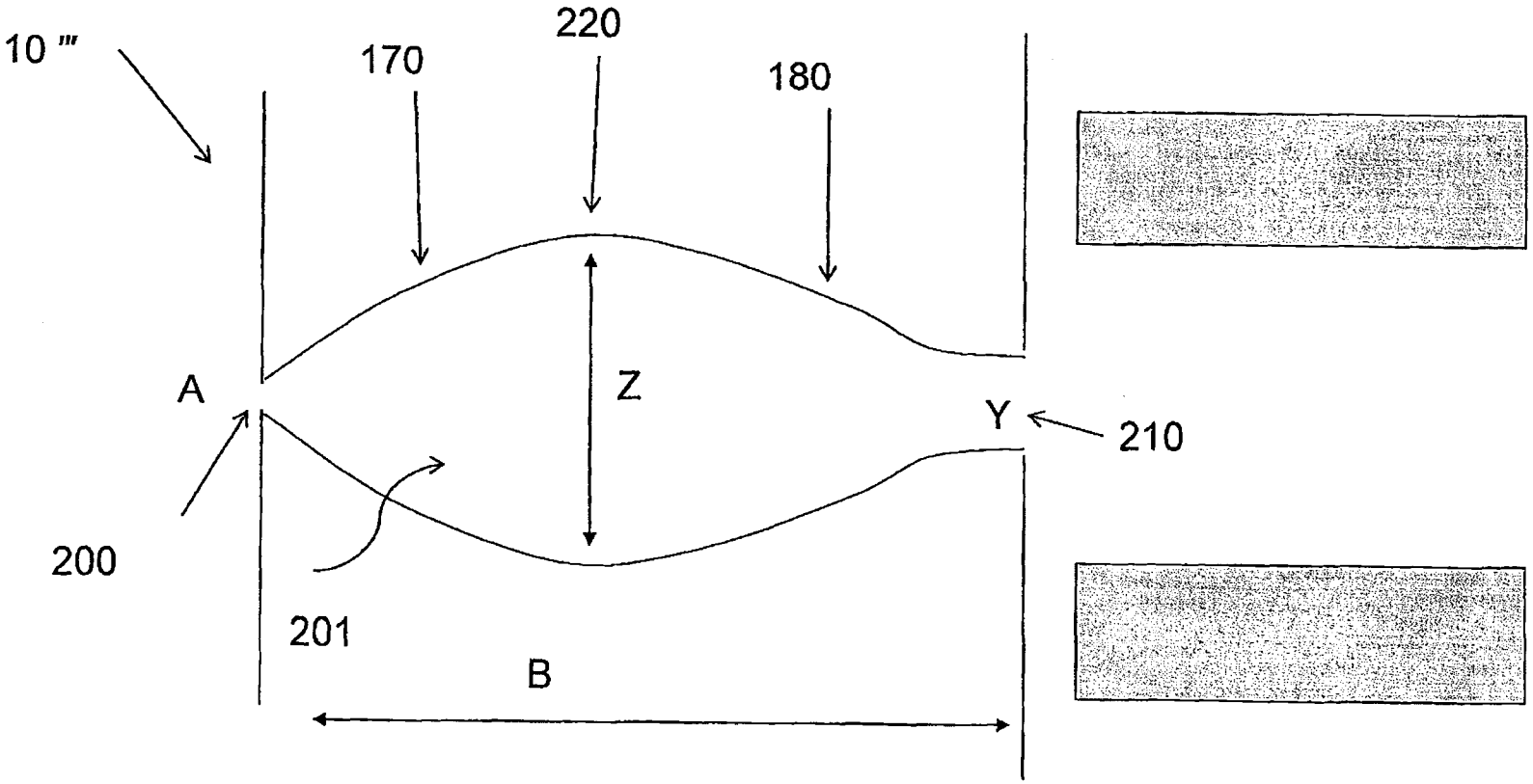
FIG. 6 is a cross sectional view of another embodiment of a gas diffuser according to the applicants' teachings.

In some embodiments, a gas diffuser 10''' comprises both an expansion region 170 followed by a compression region 180 as shown in FIG. 6. The expansion region can allow the gas to expand beyond the desired beam diameter, slowing the gas stream to a low velocity and then the flow can be recompressed to the desired diameter for the beam. In some embodiments, such expansion followed by compression can ensure that the resultant gas flow is relatively homogeneous and the momentum from the gas expansion has already been dissipated. As shown in FIG. 6, the gas diffuser 10''' can comprise a channel 201 that receives a flow of gas through an inlet orifice 200. In this illustrative embodiment, the channel 201 flares out from the orifice 200 to an inflection section 220 beyond which the channel gradually narrows to reach an exit orifice 210, thereby providing a controlled expansion and compression of the ion-containing entering gas.

In some embodiments, the diameter (A) of the gas inlet orifice 200 can be between about 1 mm and about 2 mm and the gas exit 210 diameter (Y) can be between 4 and 10 mm, e.g., to match the diameter of the RF ion guide. At its widest point (Z) the diffuser, in some embodiments, can have a size in a range between about 40 and about 20 mm. In some embodiments, the gas diffuser 10''' can have a thickness of between about 5 and about 20 mm.

By way of example, if the gas flows through the 2 mm orifice into vacuum at a rate of 0.5 Liters/sec (L/s), the gas velocity at a pressure of 5 Torr with a cross-sectional diameter of 4 mm is 100 m/sec which is far less than the sonic velocity of 436 msec.

In various embodiments, the use of a gas diffuser according to the present teachings in a mass spectrometer can provide a higher sensitivity by allowing the use of larger entrance apertures without compromising the ability of the spectrometer to focus ions efficiently.

The section headings used herein are for organizational purposes only and are not to be construed as limiting the subject matter described in any way. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A gas diffuser for use in a mass spectrometer, comprising: an input aperture for receiving a flow of a gas; and a gas flow conduit extending from said input aperture to an exit aperture, said gas flow conduit comprising a first gas flow channel in fluid communication with a second flow channel exhibiting an increasing cross-sectional area in a direction of said exit aperture so as to cause controlled expansion of the gas flow from said input aperture to said exit aperture, wherein said first and second flow channels are formed by a solid core.

2. The gas diffuser of claim 1, wherein said first channel is configured to provide a substantially annular flow region.

3. The gas diffuser of claim 1, wherein said input aperture comprises an annular aperture.

4. The gas diffuser of claim 1, wherein said gas flow conduit comprises a curved outer wall and a curved inner wall.

5. The gas diffuser of claim 3, wherein said curved inner wall comprises a surface of a solid core positioned in a cavity provided by said outer wall.

6. The gas diffuser of claim 3, wherein each of said curved inner and outer walls diverges away from a longitudinal axis of the gas diffuser as each of the walls extends from said input aperture to a respective inflection section.

7. The gas diffuser of claim 1, wherein each of said inner and outer walls converges toward the longitudinal axis of the gas diffuser as each of the walls extends from a respective inflection section to the exit aperture.

* * * * *